United States Patent [19]

Bonnema

[11] 4,361,133

[45] Nov. 30, 1982

[54] CATALYTIC SUPPORT FOR A CURLING DEVICE

[75] Inventor: James V. Bonnema, Peabody, Mass.

[73] Assignee: The Gillette Company, Boston, Mass.

[21] Appl. No.: 167,633

[22] Filed: Jul. 22, 1980

[30] Foreign Application Priority Data

Dec. 5, 1979 [DE] Fed. Rep. of Germany ..... 2948857
Dec. 25, 1979 [DE] Fed. Rep. of Germany ... 7934175[U]

[51] Int. Cl.[3] ..... A25D 1/04; F23D 3/40
[52] U.S. Cl. ..... 126/408; 431/326
[58] Field of Search ..... 431/326, 327, 347, 100, 431/127; 126/408, 409

[56] References Cited

U.S. PATENT DOCUMENTS 3,804,163 4/1974 Bradley ..... 431/328
4,248,208 2/1981 Diederich ..... 126/409

*Primary Examiner*—Samuel Scott
*Assistant Examiner*—G. Anderson
*Attorney, Agent, or Firm*—Raymond J. De Vellis

[57] ABSTRACT

In a gas-powered curling iron having a catalyst, a support for the catalyst comprising an inner member having a middle air-pervious portion and an outer member concentrically disposed about the inner member and having a catalytic substrate disposed therebetween.

4 Claims, 16 Drawing Figures

CATALYTIC SUPPORT FOR A CURLING DEVICE

BACKGROUND OF THE INVENTION

This invention relates to gas-powered curling devices which include a catalyst. More specifically, this invention relates to a hand-held curling iron having a tubular body defining a heating chamber which includes a catalyst substrate positioned in the tubular body.

In the past, gas-powered curling irons included various catalyst structures such as catalytic sleeves which were woven and treated with a catalytic material. In co-pending U.S. patent application Ser. No. 047,260 entitled "Catalytically Heated Curling Device with Improved Ignition System", now U.S. Pat. No. 4,243,017, a catalyst means in the form of a woven sleeve with an unravelled end is provided to act as a flame arrester and increase ignition efficiency in a butane-powered curling iron. Such a prior art catalytic sleeve was primarily self-supporting relying on the structural integrity of the woven sleeve. In addition, the fluffed end of the woven catalytic sleeve, which acted as a flame arrester, was difficult to manufacture and obtain repeatability characteristics.

These prior art difficulties and disadvantages have been overcome by the practice of the instant invention in which an inner and outer support member positively locates the catalyst member with respect to the tubular body of the curling iron and with respect to the associated bi-metal thermostatic element. Further, such a structure permits the usage of a catalyst member made up of randomly oriented fibers, all in an efficient system.

SUMMARY OF THE INVENTION

It is an object of this invention to provide an improved support and positioning structure for a catalyst in a gas-powered styling wand.

It is a further object of this invention to provide a structure for a catalyst which positively locates and positions a catalyst member made up of randomly oriented fibers.

It is a still further object of this invention to provide a structure for a catalyst member which is constructed to aid in reignition of the catalyst member and which is so designed to direct vaporized fuel/air flow in an efficient manner.

Briefly stated and according to an aspect of this invention, the foregoing objects are achieved by providing a catalytic structure having an inner and outer member with the inner member being formed with an air-impervious portion and a catalytic substrate disposed between the inner and outer members to positively position and orient the catalytic member. Further, the structure of the catalytic support not only properly orients the catalytic substrate but also includes means for deflecting the vaporized fuel/air flow before it escapes the catalytic substrate.

BRIEF DESCRIPTION OF THE DRAWINGS

These inventions both as to their organization and principles of operation, together with further objects and advantages thereof, may better be understood by referring to the following detailed description of embodiments of the inventions taken in conjunction with the accompanying drawings in which.

DETAILED DESCRIPTION

Figure 1:
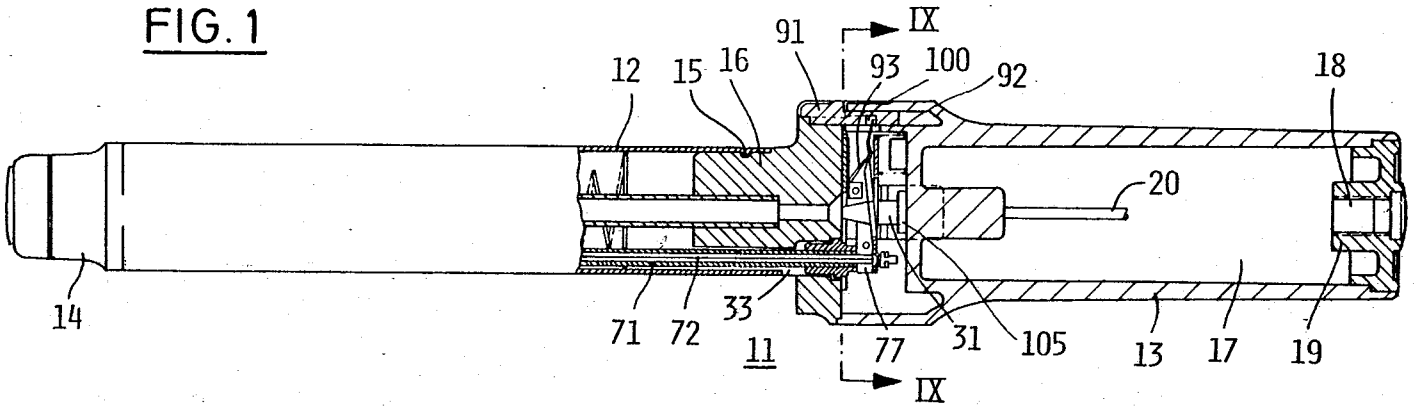
FIG. 1 is a side elevational view partially cut-away and partially in section, in accordance with this invention.
Figure 2:
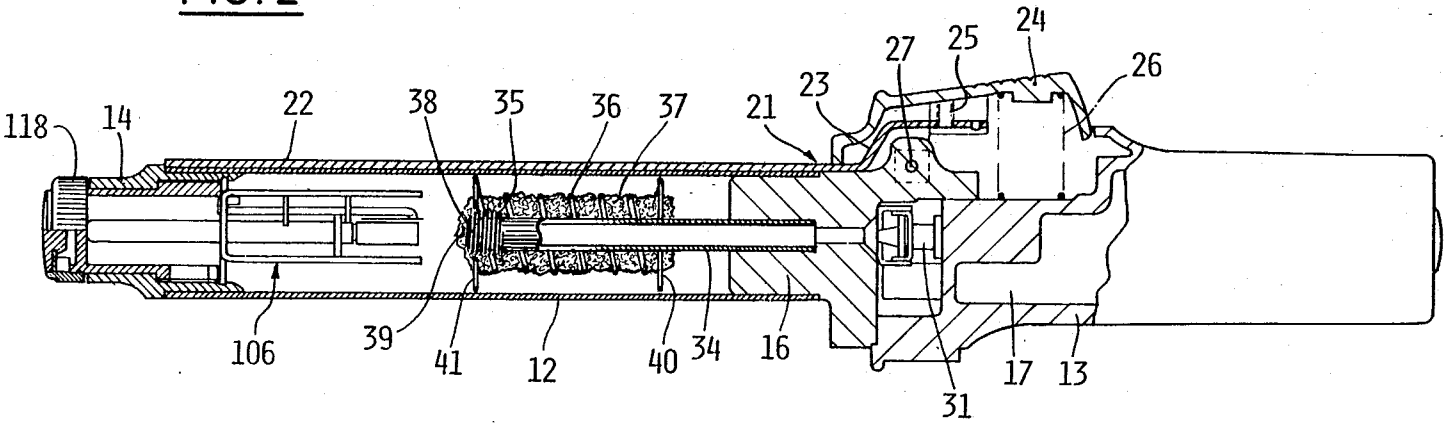
FIG. 2 is a side elevational view partially cut-away and partially in section, rotated 90° with respect to FIG. 1, in accordance with this invention.

Referring to FIGS. 1 and 2, a curling iron generally designated by the numeral 11 includes a tube portion or barrel 12 and a gripping portion or handle 13. The free end, or first end, of the barrel 12 forms a cool tip housing 14. The housing 14 may be formed of a plastic, such as a polycarbonate, and is in generally axial alignment with the barrel 12. The barrel 12, which is preferably made of a heat conductive material, such as aluminum, is circular in cross-section and may include a plurality of holes or rows of holes in a manner well known in the art to provide exhaust means for the consumed fuel/air mixture from the interior of the barrel 12.

The other end of the barrel 12 is connected, such as by a press fit or crimp 15 to a sleeve member or housing 16. The housing 16 is further connected to the handle 13 by any means well known in the art, such as press fitting, screws, or the like.

The hollow interior or reservoir 17 of the handle 13 forms a pressure vessel. The pressure vessel, which may be formed of nylon or the like, includes a refill valve 18 disposed in an end plug 19, all as well known in the art. The refill valve 18 may be any well known valve system adapted to receive a mating stem of a container of butane or the like. The reservoir 17 of the pressure vessel receives and retains fuel in a liquid state in the handle 13 of the curling iron 11.

The pressure vessel need not be permanently fixed to the housing 16 of the curling iron 11. The curling iron 11 may be adapted so that the handle 13 which includes the reservoir 17 is releasably attached to the housing 16 in order that a disposable cartridge may be utilized. In general, the reservoir 17 holds approximately 10 grams of fuel, in an exemplary embodiment, which suffices for a plurality of curling sessions.

Disposed in the reservoir 17 of the pressure vessel is a wick member 20. Wick member 20 may be formed as a lining covering the inner walls of the pressure vessel. The wick member 20 may be made from a fibrous material, such as filtering paper, textile materials, or other absorptive material.

Although the embodiment described herein discloses a curling iron with a fuel supply located at one end of the curling iron and an ignition system located at the other end of the curling iron, the location of such components may be juxtaposed or serve a dual function and still be within the scope of this invention. Further, although not shown in the drawings, a cover for the barrel 12 of the curling iron 11 may be provided.

Connected to the exterior of the curling iron 11 is a hair clip 21, best shown in FIG. 2. The hair clip 21 has a first portion 22 substantially conforming to the shape of the outer surface of the barrel 12. A first portion 22 is integrally formed with a second portion 23 which in turn is fastened to a button member 24 by means such as screw 25. First portion 22 is raised outward from the barrel 12 when its associated button member 24 is compressed toward the handle 13 thereby overcoming the biasing force of a coil spring 26 located in the hollow of button member 24. The hair clip 21 is accordingly pivotably mounted about pin 27 in a manner well known in the art. The first portion 22 and second portion 23 of the hair clip 21 is preferably formed of a metal material. The button member 24 is preferably formed of a plastic material.

Figure 7:
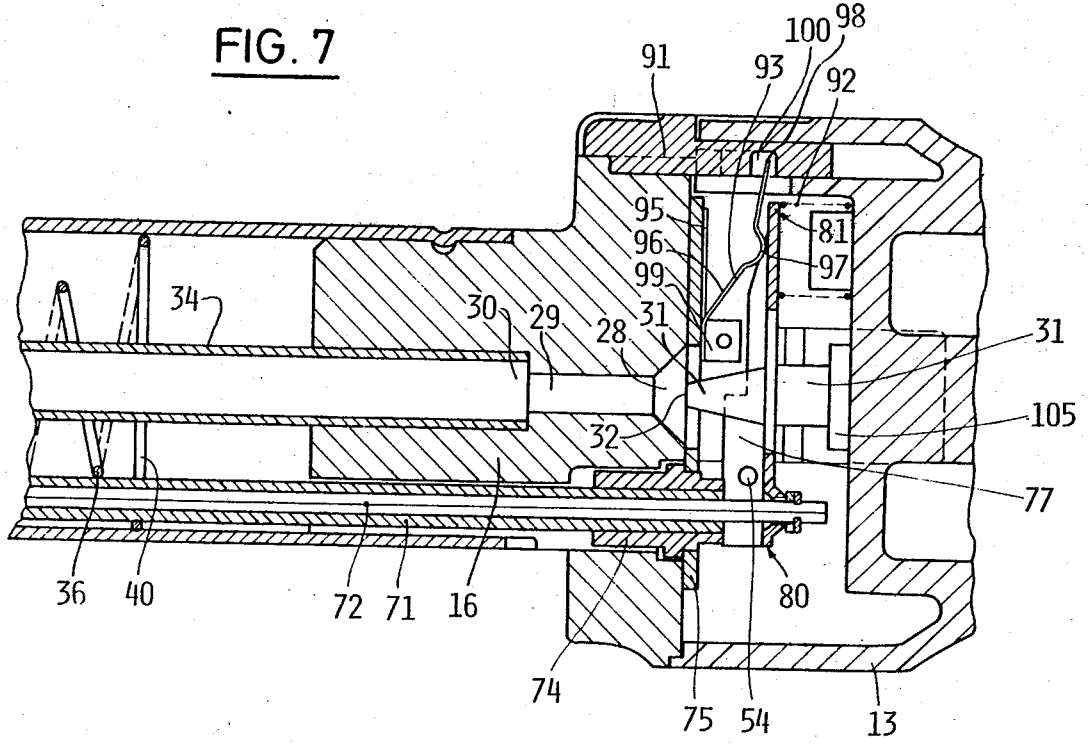
FIG. 7 is an enlarged side elevational sectional view, showing a detailed view of the temperature control system of FIG. 1, in accordance with this invention.
Figure 8:
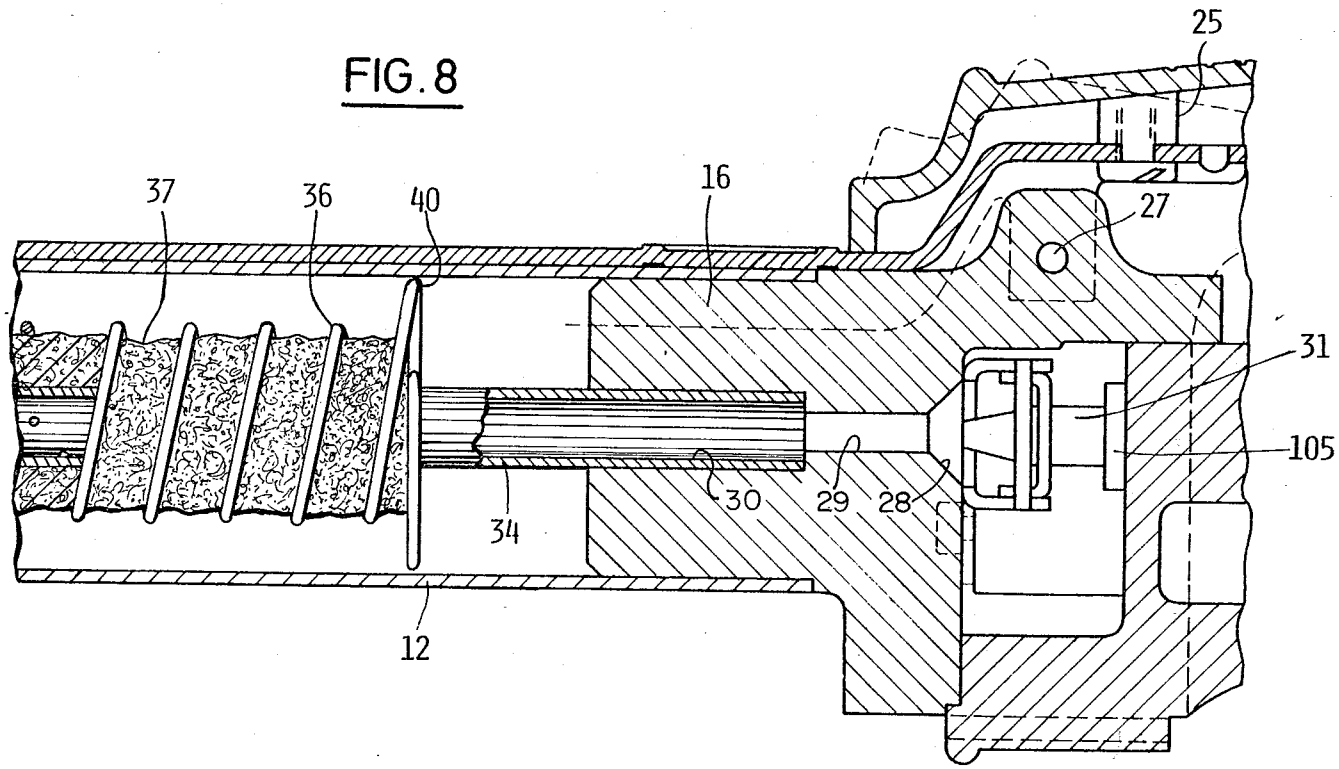
FIG. 8 is an enlarged side elevational sectional view, of portions of the device shown in FIG. 2, in accordance with this invention.

The housing 16, which is formed of a plastic or the like best seen in FIGS. 7 and 8, defines a truncated conically shaped cavity 28. At the widest portion of the cavity 28, the diameter may be approximately 300/1000ths of an inch. The diameter depends upon the parameters of the system such as the size of the orifice of the nozzle and the velocity of the butane.

In fluid communication with the cavity 28 is a generally cylindrical cavity 29 having an inside diameter such as 60/1000ths of an inch. Also within the housing 16 is a concentrically aligned cavity 30 having an inside diameter greater than that of cavity 29 such as approximately 250/1000ths of an inch. The cavities 30, 29, and 28 provide fluid communication to the interior of the barrel 12 for the gas released from valve stem 31 through its orifice 32 located at the tip of the valve stem 31. A gem (not shown), including an aperture having a diameter of approximately 2.5/1000ths of an inch, may be positioned in the tip of the stem 31.

In operation, the butane gas is released through the orifice 32 of valve stem 31 into the cavity 28. The orifice 32 in the tip of the valve stem 31 increases the velocity of the gas which lowers the pressure in the cavity 28 allowing air to be combined therewith. The air is pulled in to mix with the vaporized gas through various openings of the structure on the casing itself such as air channel 33 shown in FIG. 1. The vaporized fuel/air mixture travels through cavities 29 and 30 and is introduced into the interior of the cylindrical barrel 12.

Positioned coextensively with the barrel 12 is a tube 34. The first end of the tube 34 is proximate to the handle 13. The first end of tube 34 is disposed in the cavity 30 of housing 16 and is held therein by means well known in the art such as by friction fit. The tube 34 has disposed about a portion of its outer surface an inner coil wire form 35 and an outer coil wire form 36 best shown in FIG. 2. Both coil wire forms 35 and 36 are preferably made of a high temperature resistant wire. Wire forms 35 and 36 may be of different diameters. Alternatively, the diameters of the coil wire forms 35 and 36 may each be approximately 20/1000ths of an inch. Disposed between the tube 34 or the inner coil wire form 35 and the outer coil wire form 36 is a generally cylindrical catalyst member 37.

The portion of the tube 34 disposed inside the catalyst member 37 includes a plurality of apertures such as holes or slots to allow the vaporized fuel/air mixture to pass through the tube 34 and react with the catalyst member 37. When a tube such as tube 34 is used in this invention, it is preferable that no perforations, apertures or the like occur through the walls of the tube 34 until the portion of the tube 34 is reached in which the fuel/air mixture will pass through the catalyst member 37.

As an alternate embodiment, in place of the tube 34 with its perforations, the inner coil wire form 35 can be extended, from its end proximate the handle 13, in a tightly wound air impervious fashion and positioned in frictional engagement within the wall of the cavity 30. In such an embodiment, several convolutions or turns of the mid-portion of the inner coil wire form 35 disposed inside the catalyst member 37 would be axially expanded to permit the proper quantity of fuel/air mixture to react with the catalyst member 37 while providing sufficient support.

The end of the inner coil wire form 35 proximate the cool tip housing 14 is wound in a tightly compressed and tapered fashion to form a cap 38. A small aperture 39 is defined in the cap 38 approximately coaxial with the axis of the tube 34. When the vaporized fuel/air mixture passes through the tube 34, the cap 38 prevents most of the fuel/air mixture from escaping from the free end of the tube 34. The fuel/air mixture is accordingly forced through the catalyst member 37 to realize efficient burning. The aperture 39, although not necessary, is preferred since it aids in efficient ignition in a manner to be described below. The cap 38 could also be formed from a piece of metal either separate or integral with the inner coil wire form 35 or as part of the tube 34. Its formation as part of the inner coil wire form 35 is both inexpensive and convenient, and accordingly preferable.

The outer coil wire form 36 has a right end convolution or turn 40 and a left end convolution or turn 41 best seen in FIG. 2. The turns 40 and 41 are of a diameter such as to fit the inner diameter of the barrel 12. The outer coil wire form 36 provides support and dimensional stability to the catalyst member 37 and to a bimetal thermostat element to be described subsequently. The turn 40 may be attached to, or substituted by, a spacer disposed between the housing 16 and the catalyst member 37. Such a spacer (not shown) may also act as a heat sink and aid in the positive alignment of the inner coil wire form 35 when the inner coil wire form 35 is configured to substitute for the tube 34 in the manner previously described. In addition, such a spacer may provide desirable heat transfer of the heat generated by the burning of the gas to barrel 12. Such a spacer may also provide further structural positioning and support for the bimetal thermostat element to be described subsequently.

The number of convolutions or turns between the turns 40 and 41 of the outer coil wire form 36 should be of any convenient number, such as six, required to positively locate the outer surface of the catalyst member 37 without unnecessarily interfering with the transfer of heat generated therein to the barrel 12.

In a preferred embodiment, the catalyst member 37 is a collection of randomly oriented fibers formed of clear fused quartz from rock crystal or ceramic material. These fibers may be formed in a manner well known in the art, such as by the use of a spinneret. The resulting isotropic collection of unrelated fibers, in a quantity such as in the order of 50 milligrams, forms the base or substrate for treatment with a catalytic solution in a manner well known in the art. Preferably, the catalytic material contained in the catalytic solution will be a platinum or platinum/palladium compound. Once treated to form the catalyst member 37, a quantity of such fibers is positioned between the inner coil member 35 and the outer coil member 36 making sure that sufficient fiber material is used so that the path of the fuel-/air mixture through the tube 34 will pass through the catalytic member 37.

The combination of the inner coil wire form 35 terminating in cap 38 and outer coil wire form 36 with its larger turns 40 and 41 provides proper support and positive placement of the catalyst member 37. Further such a structure positively positions the associated bimetal thermostat element, with respect to the interior of the barrel 12 between outer turns 40 and 41 and the inner coil wire form 35. Still further, such a structure provides for an improvement over a sleeve type catalyst in that it provides for a more even diffusion of the fuel-/air mixture through the catalyst member 37 toward the outer surface of the barrel 12 to prevent unwanted hot spots or uneven heating characteristics for the curling iron 11. This simple straightforward structure allows the use of a randomly oriented fibrous material impregnated with a catalyst to be effectively utilized in a mass produced system.

An additional benefit is achieved when the tube 34 or its alternative inner coil wire form is formed of a low heat conductive material having a high heat capacity. If the barrel reaches too high a temperature in a manner to be described subsequently, the fuel supply for the curling iron may stop for a period of time. When the flow restarts, the heat retained in the tube or inner coil wire form under the catalyst member 37 will cause the oxidative catalytic reaction to begin again without the need for an additional ignition spark or reignition process by maintaining the catalyst member 37 at a sufficiently higher temperature.

Another advantage exists when the inner coil wire form 35 is used in place of the solid tube 34 in that a wound structure provides a more tortuous heat conduction path and aids in keeping the housing 16 cool.

The catalyst mounting structure defined above provides accuracy and reliability with respect to the positioning of the thermostat element. That is, the spatial relationship between the heating chamber portion of the curling iron and the thermostat is set so that the fibers making up the catalyst member 37, which heat up when the fuel is oxidized, will not likely come in contact with the thermostat element and provide a false reading.

Referring now to the vaporizer/valve system of the curling iron 11, it is noted that U.S. Pat. No. 4,177,646 entitled "Liquified Gas Apparatus" assigned to S. T. Dupont, discloses liquified gas apparatus vaporizer-pressure reducer assemblies. The valve assembly of this patent is suitable for the curling iron disclosed herein and accordingly, the disclosure of U.S. Pat. No. 4,177,646 is incorporated herein by reference.

Figure 13:
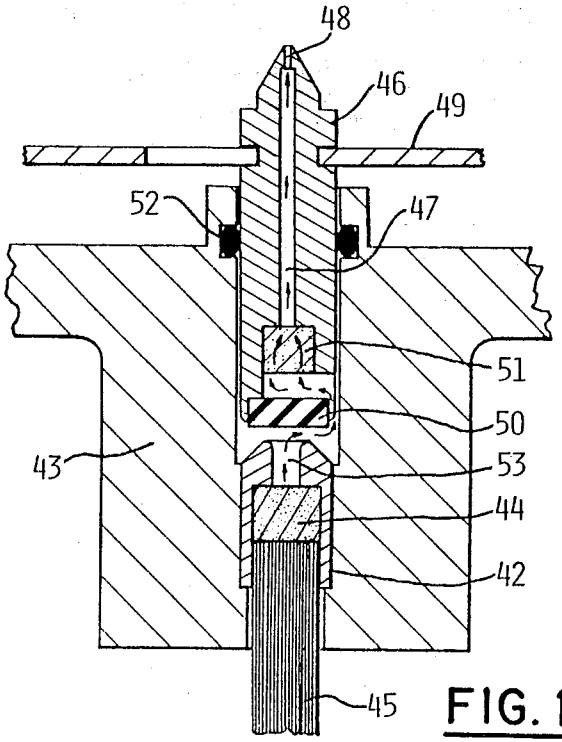
FIG. 13 is an enlarged detailed sectional view of the vaporizer/valve assembly of FIG. 1, in accordance with this invention.

Referring specifically to FIG. 13, a valve assembly is shown which includes an aluminum sleeve 42 pressed into a cavity formed in a housing 43 which may also be a wall of a pressure vessel containing a gas such as butane. Pressed into the sleeve 42 is a sintered metal plug 44 and a wick member 45. The wick member 45 is disposed in the interior reservoir of a pressure vessel and carries butane fuel or the like from the reservoir of a pressure vessel to the sintered metal plug 44. The sintered metal plug 44, which may be formed of stainless steel, acts as a vaporizer and its size, shape, and material define the maximum flow of fuel from an associated pressure vessel, all in a manner well known in the art.

Partially disposed in the cavity formed in housing 43 is a valve stem 46. Valve stem 46 may be formed of plastic, brass, or the like and includes a main passageway 47 and a nozzle passageway 48. Passageways 47 and 48 provide fluid communication from the downstream or exit surface of sintered metal plug 44 to the mouth of a tube or cavity as previously described. The diameter of the main passageway may be in the range of 0.03–0.04 inch and that of the nozzle passageway may be in the range of 2–4/1000ths of an inch. A gem (not shown) having a hole bored therethrough may be positioned in the tip end of the valve stem 46 to act as a nozzle passageway.

The valve stem 46, which is illustrated in its open position in FIG. 13, is axially movable in the cavity of housing 43 in response to the force transmitted to it from a lever or control plate 49 which is part of the automatic temperature control system to be described subsequently. Movement of plate 49 causes valve stem 46 to travel axially into the cavity of housing 43 when the associated thermostat exceeds a predetermined temperature or when the on/off switch of the curling iron is placed in an "off" position.

Disposed on the upstream side of and fastened to the valve stem member 46 is a fuel impervious rubber pad 50 made from a material such as of a Viton rubber. Disposed downstream from the fuel impervious pad 50 is an optional fuel filter member 51. The filter member 51, which may be formed of a porous material, is press fit into a cavity of valve stem 46 to provide a filtering of the butane fuel if necessary. Completing the embodiment shown in FIG. 13, an "O" ring 52 is provided which is disposed about the valve stem 46 to prevent the downstream movement of the vaporized fuel other than through the nozzle passageway 48.

In operation, the flow of the vaporized fuel from the exit surface of the sintered metal plug 44 follows a path as indicated by the arrows of FIG. 13 through a valve opening 53 around the pad 50, through filter 51, through a main passageway 47 to ultimately be dispensed from the tip end of nozzle passageway 48. The shape of the pad 50 should be such that vaporized fuel flow will occur when the pad is physically separated from the top of the valve opening 53. When the upstream side of the pad 50 blocks off the valve opening 53, vaporized fuel flow will cease. Accordingly, when the upstream surface of the pad 50 approaches the point of totally blocking off the vaporized fuel flow, reduction of vaporized fuel flow will result through the system. Thus the regulation of the vaporized fuel flow is accomplished automatically in response to the temperature of the heating chamber.

Even when the vaporized fuel flow is cut off from the system after a period of use, the catalytic operation of the catalyst member 37 will continue to be "hot" for a period of time. This is especially true when the tube or inner coil wire member 35 is made of a low thermally conductive material such as a metal having a high heat capacity. During such time, if fuel is reintroduced to the catalytic member 37, which will happen when the temperature of the heating chamber or barrel decreases sufficiently to cause a relaxation of the associated bimetal thermostat element and thus an axial movement outwardly of the associated valve stem, combustion will continue in a normal manner without any need for reignition.

Figure 14:
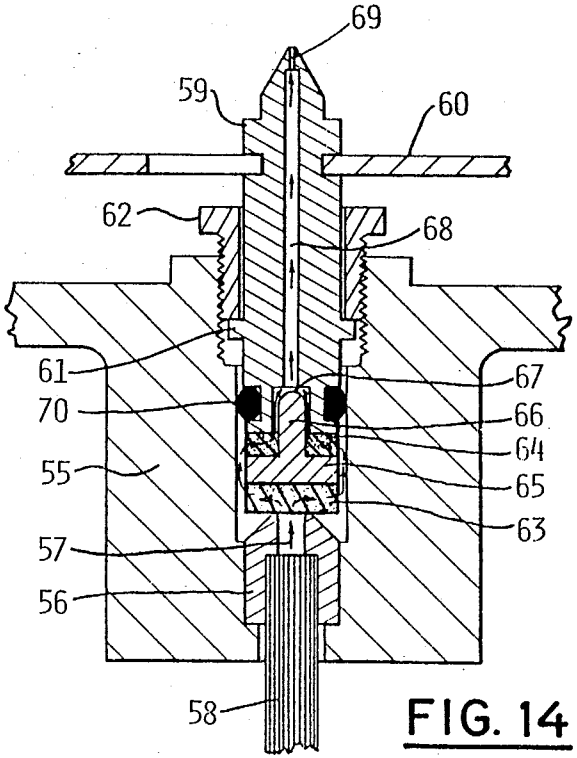
FIG. 14 is an enlarged detailed sectional view of an alternate embodiment of the vaporizer/valve assembly of FIG. 1, in accordance with this invention.

FIG. 14 illustrates an alternative valve assembly which not only provides the on/off function of the embodiment of FIG. 13 when regulating the flow of vaporized fuel, but also provides a more controlled metering of vaporized fuel flow. Mounted in a cavity formed in a housing 55, which may also be a wall of a pressure vessel, is a pressed fit aluminum sleeve 56 having a valve opening 57 disposed in its downstream side. Disposed in the sleeve 56, in a manner such as by press fitting, is a wick member 58 composed of fiber, cloth, or the like. The wick member 58 delivers the liquid fuel in the reservoir of an associated pressure vessel to the valve opening 57. A valve stem 59 rides freely in the cavity of housing 55 and is connected to a lever or plate 60 by a locating groove. Plate 60 is part of the temperature control system and causes an axially inward force to be applied to the valve stem 59 when the temperature of the associated heating chamber exceeds a predetermined temperature or when the associated on/off control is placed in its "off" position.

The valve stem 59 also includes a shoulder portion 61 positioned in the cavity of the housing 55 by means of a control nut 62. The control nut 62 is screwed into the threaded downstream side of the cavity of housing 55, its setting limiting the outward travel of the valve stem 59 and providing a maximum flow setting by deforming a two-piece vaporizing means. The vaporizing means is made up of two pieces of an open cell foam such as a polyether and comprises upstream vaporizing member 63 and downstream vaporizing member 64. Disposed between the downstream vaporizing member 64 and the upstream vaporizing member 63 is a fuel impervious barrier or plunger 65 having an upstanding finger portion 66 which is disposed in a passageway 67 of the valve stem 59. The passageway 67 leads, in a manner described previously, through a main passageway 68 and out the top of nozzle passageway 69.

An "O" ring 70 is disposed about the lower portion of the valve stem 59 to prevent fluid communication downstream of the "O" ring 70 except through main passageway 68 and the nozzle passageway 69. The foam pads or vaporizing members 63 and 64 insure a complete vaporization of the butane fuel from its liquid to gas state as the butane passes through their pores or cells. The amount of butane passing through the members 63 and 64 is controlled by the downward pressure of valve stem 59 controlled in turn by the automatic temperature control. This pressure forces the gas through the nozzle passageway 69 and thereby producing a gas stream of sufficient velocity to aspirate air together with the vaporized gas into the mouth of a tube or cavity. The desired fuel/air mixture at the exit of the tube or cavity may preferably be on the order of ten or more parts of air to one part of vaporized fuel.

Thus in FIG. 14 the vaporized fuel flow, when the pressure on the members 63 and 64 permits any flow, will travel in the direction of the arrows, through member 63, about the side of plunger 65, through member 64, through passageways 67 and 68, and through the end of nozzle passageway 69 to provide vaporized fuel in the manner previously described.

Figure 15:
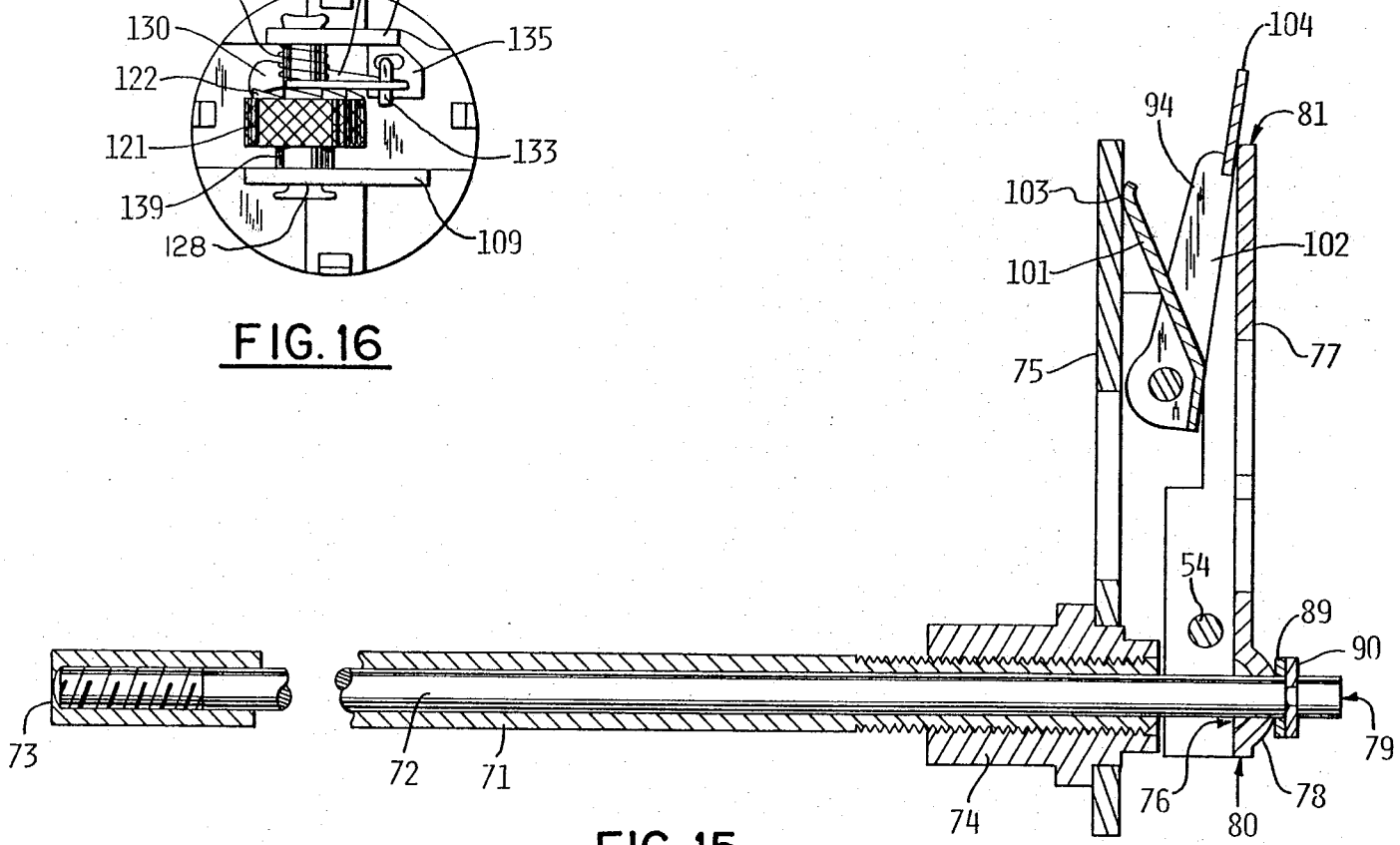
FIG. 15 is an enlarged side elevational sectional view, of components of a temperature control on/off system, in accordance with this invention.

As best seen in FIGS. 1, 7, and 15, the above referred to bi-metal thermostat element is provided in the form of a tube 71 preferably made of brass and a rod 72 preferably made of steel disposed inside tube 71. The bimetal thermostat element made up of tube 71 and rod 72 is positively mounted with respect to the heater portion of the curling iron 11 to achieve reliable temperature control. That is, the bi-metal thermostat element is positioned, as can be best seen in FIG. 7, a predetermined distance from the interior wall of the barrel 12 between the turns 40 and 41 of outer coil wire form 36 and the remaining turns of outer coil wire form 36. If a heat sink/spacer is used between the housing 16 and the coil wire forms, an aperture therethrough will provide additional support to positively orient the bi-metal thermostat element. Other manners of positively orienting the bi-metal thermostat element may also be employed. The use of the tube/rod bi-metal thermostat in a curling iron is shown in British Pat. No. 1,517,600 assigned to Braun Aktiengesellschaft, the disclosure of which is incorporated herein by reference.

As can best be seen in FIG. 15, the tube 71 and rod 72, of the bi-metal thermostat element are fastened together at free end 73. For example, the steel rod 72 may be threaded into the brass tube 71 in a manner well known in the art. Other manners of affixing the free end of the bi-metal thermostat element such as by notching or crimping may also be utilized.

Figure 11:
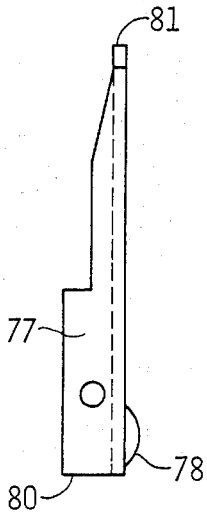
FIG. 11 is a right side elevational view of the control lever of FIG. 10, in accordance with this invention.
Figure 10:
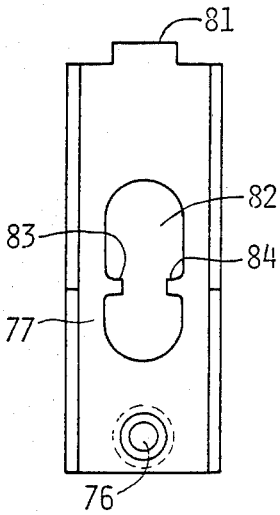
FIG. 10 is a bottom plan view of a control lever of FIG. 9, in accordance with this invention.
Figure 12:
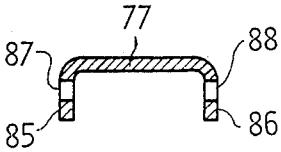
FIG. 12 is a cross-sectional view taken along line XII—XII of FIG. 9, in accordance with this invention.

The tube 71 is also threaded into a clamping bushing or control nut 74 at its other end. The positioning of the tube 71 in the control nut 74 provides calibration to the system in a manner well known in the art. The control nut 74 is screwed into a threaded aperture or otherwise affixed to a mounting plate 75. The mounting plate 75 is attached to the housing 16 in a manner well known in the art. The rod 72 continues through the tube 71 affixed in the threaded aperture in the mounting plate 75 and through an aperture 76 in a lever or control plate 77. The control plate 77 is best seen in FIGS. 10, 11, and 12.

More specifically, a domed portion 78 is formed on the first end 80 of control plate 77. An aperture 76 is defined in the center of the domed portion 78 to allow the end 79 of the rod 72 to pass therethrough. The end 79 of the rod 72 is allowed to move freely in a direction toward the handle 13 of the curling iron 11. The end 79 of the rod 72 is prevented from freely moving in a direction toward the cool tip housing 14. At a predetermined point, a force is exerted on the first end 80 of the control plate 77 which then causes the plate 77 to pivot about a pivot point at pin 54 in a clockwise direction. A washer 89 and a clip 90 located at the end 79 of the rod 72 provide a stop to control the free movement of end 79 of the rod 72.

Referring to FIGS. 9 through 12, the control plate 77 is shown with its first end 80 and second end 81. Disposed through control plate 77 is a generally oval aperture 82, through which is disposed a portion of the valve stem 31. Arms 83 and 84 of the control plate 77 engage a mating groove in the valve stem 31 in a manner illustrated in FIGS. 13 and 14. Accordingly, the movement of control plate 77 causes the axial displacement of the valve stem 31 and thereby controls the flow of vaporized fuel. The control plate 77 is integrally formed in a generally U shape with leg portions 85 and 86. Apertures 87 and 88 are formed in the leg portions 85 and 86 respectively for receiving pin 54.

In operation, as the temperature sensed by the bi-metal thermostat element increases, the brass tube 71, located closer to the heat source and with a higher coefficient of thermal expansion than that of the steel rod 72, increases in length. Since the brass tube 71 is secured at both its ends, its expansion pulls the inner steel rod 72 toward the cool tip housing 14 of the curling iron 11. As the rod 72 is pulled, the washer 89 attached to the end 79 of rod 72 abuts the crest of the dome portion 78 of the control plate 77. The end 80 of the control plate 77 is caused to pivot in a clockwise direction about pin 54 and thereby forcing the valve stem in a downward or "off" position.

Figure 9:
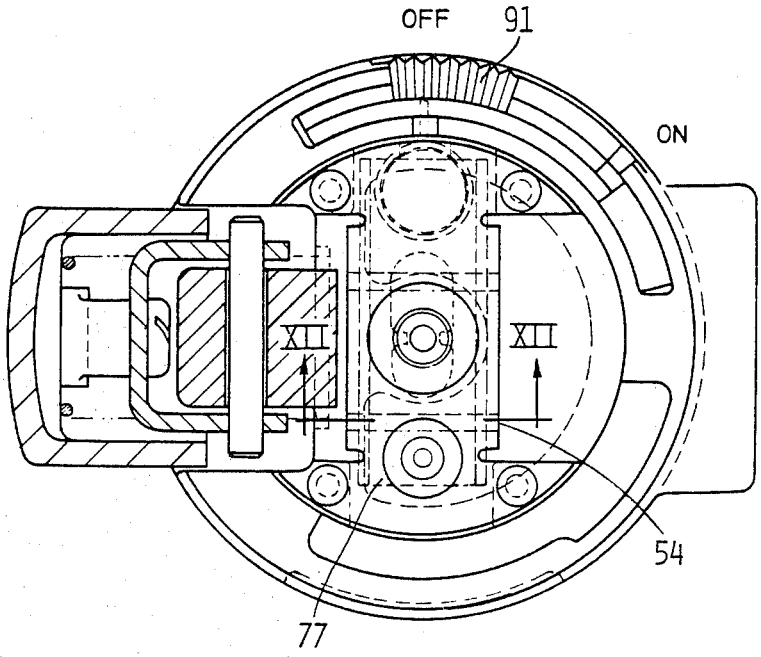
FIG. 9 is an enlarged cross-sectional view taken along line IX—IX of FIG. 1, in accordance with this invention.

As the bi-metal thermostat element recovers, i.e. cools, the brass tube 71 decreases in length and accordingly pushes the end 79 of rod 72 in a direction toward the handle 13 of the curling rod 11. Assuming that the on/off manual control switch 91, shown in FIG. 9, is in the "on" position, the end 80 of control plate 77 is pivoted in a counterclockwise direction about pin 54 due to the biasing force of coil spring 92, best shown in FIG. 7. The spring 92, located under the end 81 of control plate 77, urges the end 81 of plate 77 toward the cool tip housing 14 until the top of the domed portion 78 of control plate 77 abuts washer 89. As the end 81 of control plate 77 is urged upward, the connected valve stem 31 is lifted in an axial direction and vaporized fuel flow is increased.

A control spring such as control spring 93 in FIG. 7 or alternatively control spring 94 shown in FIG. 15 acts in combination with the on/off switch 91 best shown in FIG. 9. Referring now to the control spring 93 shown in FIG. 7, the spring 93 is formed of a piece of resilient metal and has a first arm 95 attached to the underside of mounting plate 75 and a second arm 96. The second arm 96 includes a bent portion 97 and an end 98. The first arm 95 and the second arm 96 are connected by plate 99 which may be affixed to the curling iron 11 in a manner well known in the art. The end 98 of arm 96 is positioned in an arcuate recess 100 located on the underside of circumferentially located on/off switch 91. As the switch 91 is turned from its "off" position as shown in FIGS. 7 and 9, the arcuate recess 100 travels in a direction toward the mounting plate 75 and accordingly, the end 98 of arm 96 travels therewith and releases tension on the upper surface of end 81 of control plate 77.

In operation, in the "off" position, the bent portion 97 of arm 96 provides a sufficient force to the end 81 of control plate 77 to overcome the force of spring 92 and accordingly force the valve stem 31 in an axially downward direction to cut off fuel flow. This is accomplished without regard to the state of the bi-metal element and in a simple straightforward manner. This design avoids the necessity of a complex lever and spring arrangement to control a valve stem by both a bi-metal thermostat element and an on/off switch. Further, this design uses a rod/tube bi-metal thermostat element which operates to move a valve stem in a plane parallel to the axis and motion of the bi-metal thermostat element all in a straightforward compact design.

Another example of a control spring is that shown in FIG. 15 as spring 94 with arms 101 and 102. Proximate the free end of arm 101 is a humped portion 103 which abuts the underside of the mounting plate 75. The end portion 104 of arm 102 is positioned in an arcuate recess located on the underside of the on/off switch 91 in a manner similar to that shown in FIG. 7.

Springs 94 or 93 have no function during temperature control. Only when an arm of the spring is positioned in the "off" position, as shown in FIG. 15, does it override the bi-metal thermostat element and cause the valve stem to move in an axially inward or down position to block the fuel flow. A temperature control system with a cooperating independent on/off control is accordingly provided in a simple, straightforward, easy-to-manufacture system without the use of multiple levers and springs.

Summarizing the operation of the temperature control system, the tube 71 reacts actively to the influence of temperature. That is, it undergoes considerable expansion while rod 72 undergoes comparatively little expansion. The difference in length determines the control path, or path through which the free end 79 of rod 72 is moved. The movement of valve stem 31 with respect to fixed valve seat 105 can be influenced both by the rod 72 and the position of the on/off switch 91. When the on/off switch 91 is in the "on" position, a recess such as arcuate recess 100 moves toward the barrel 12 of the curling iron 11. In other words, the load on spring 92 is relieved. When the switch 91 is moved to the "off" position, as shown in the drawings, the force of springs 93 or 94 overcomes that of spring 92 wherein valve stem 31 mates with valve seat 105 and fuel flow is prevented. Thus the control plate 77, which is pivotally mounted in housing 16, has acting on its second lever arm or end 81, springs 93 or 94 and 92 and, on its first lever arm or end 80, a bi-metal thermostat element 71, 72.

When the manual on/off switch 91 is placed into its "off" position, the control plate 77 receives a force in the direction toward the fuel supply. This force overcomes the force of the spring 92 thereby forcing the valve stem 31 in a downward direction to shut off the fuel supply. That is, end 81 of the control plate 77 is pivoted in a clockwise direction about pin 54. In the "off" position, the end of the control plate 77 proximate the bi-metal thermostat element floats freely since the control plate 77 is not connected to the bi-metal thermostat element, and thus the bi-metal thermostat element cannot act as a stop to prevent the manual "off" override.

When the on/off switch 91 is placed in its "on" position, the arm of the spring 93 or 94, which is engaged in the recess of on/off switch 91, is moved forward by riding in a slot. The end 81 of control plate 77 is urged by spring 92 to pivot in a counterclockwise direction about pin 54 thereby causing movement of the associated valve stem 31 in an axially forward position. In the "on" position, if the bi-metal thermostat element is in an orientation in which it still has a memory of heat, the limit of travel of the valve stem 31 will accordingly be limited.

Thus with a fulcrum point or pivot between the tube/rod bi-metal thermostat element and the valve stem, the motion of the bi-metal element is translated 180° to the motion of the valve stem. That is, the motion of the bi-metal element is opposite in direction and along a parallel axis to that of the valve stem. This results in a compact bi-metal element structure with a manual "off" override in a straightforward design.

In order to insure immediate operational readiness in a reliable, straightforward, compact manner, an ignition device generally referred to as ignition system 106 shown in FIG. 2 is disposed in the cylindrical rod or barrel 12 upstream of the heating chamber.

Figure 3:
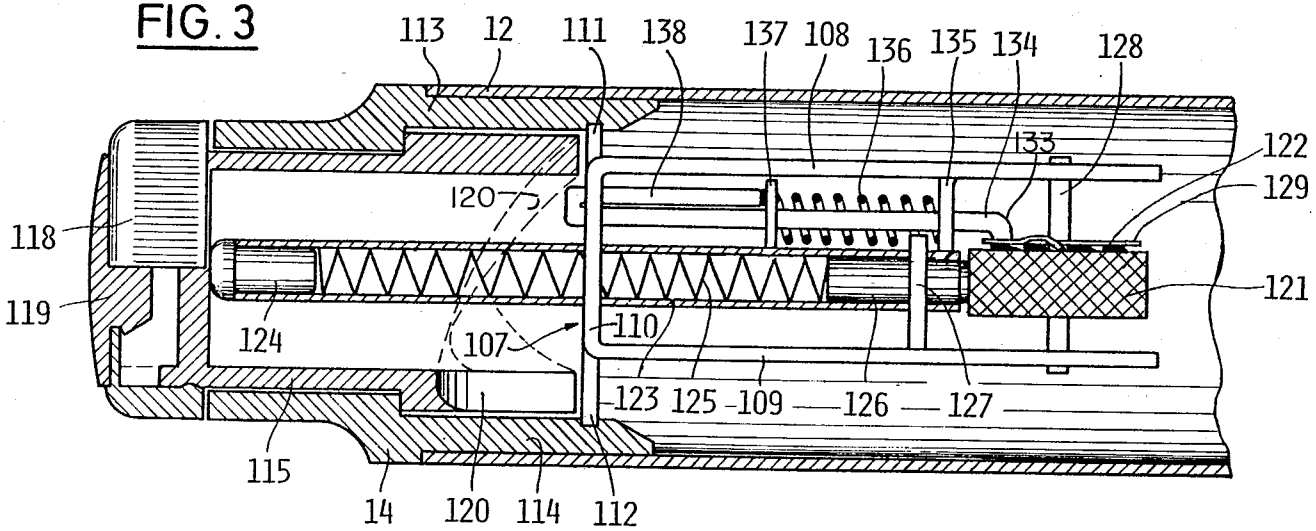
FIG. 3 is an enlarged side elevational view, partially in section, showing a detailed view of the ignition system of FIG. 2, in accordance with this invention.

Referring to FIG. 3, an integral one-piece, metal, "U" shaped frame member 107 is employed for mounting the various components of the ignition system. The frame member 107 comprises an upper portion 108, a lower portion 109 and a connecting portion 110. The connecting portion 110 includes tabs 111 and 112 which are bent from upper and lower portions 108 and 109 respectively. The tabs 111 and 112, as well as the other parts of connecting portion 110 engage, in a detent snap fit arrangement, fingers, such as fingers 113 and 114 of cool tip housing 14.

Figure 4:
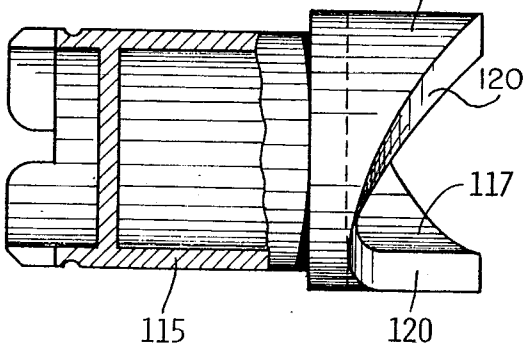
FIG. 4 is a side view, partially in section, of a portion of the ignition system shown in FIG. 3, in accordance with this invention.

A two-lobed, rotary member 115 preferably made of plastic and best seen in FIG. 4 comprises lobes 116 and 117 and is positioned inside the cool tip housing 14. A knurled or grooved wheel 118 formed of a plastic or the like is permanently affixed to the forward end of the rotary member 115 for rotation therewith. A plug or cap member 119 made of a flexible plastic or the like is press fit into the center hole of the wheel 118. When the wheel 118 is turned 180° by the user of the curling iron, a full cycle of the member 115 is achieved. That is, the perimeter thickness of the two lobes of member 115 define an arcuate path 120. The full travel of the arcuate path 120 by an indexing member to be described subsequently constitutes two cycles. Stated another way, the travel of an indexing member from the bottom of one lobe to the bottom of the other lobe constitutes one cycle.

The ignition system 106 comprises a flint sparker or friction wheel 121 with an attached ratchet member 122. The ratchet member 122 includes a plurality of sawtooth-like teeth concentrically disposed and attached about the periphery of the friction wheel 121. A tube member 123 is disposed in the forward end of the barrel 12 of the curling iron 11 with its axis being the same as or parallel to the axis of the barrel 12. The tube member 123 includes a plug 124 and a spring 125 which provides a biasing force to a flint 126 against the outer surface of the friction wheel 121. The tube member 123 is mounted in the curling iron 11 and held in position through an aperture in the connecting portion 110 of frame member 107 and an aperture in integrally formed tab 127 of the lower portion 109 of frame member 107.

Figure 16:
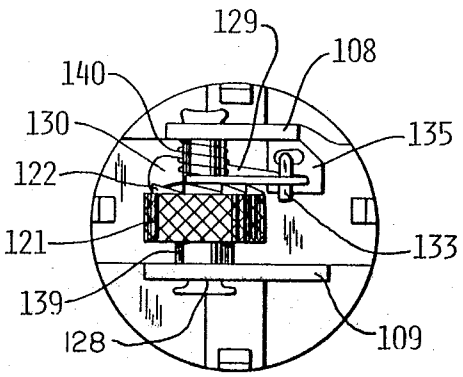
FIG. 16 is a right side elevational view of an embodiment similar to that of FIG. 3, in accordance with this invention.

The friction wheel 121 with its ratchet member 122 is mounted on an axle member 128 which is held in place by upper portion 108 and lower portion 109 of frame member 107. As seen in the embodiment of FIG. 16, a spacer 139 may be positioned about a portion of the axle member 128 to provide a proper alignment and mounting of the friction wheel 121. A spring member 140 may also be positioned about a portion of the axle member 128 to provide a force for the proper engagement between a linkage member 129 and the ratchet member 122.

Figure 5:
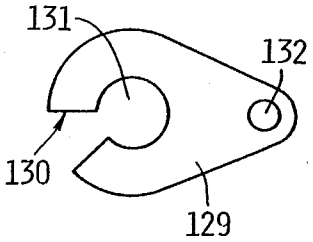
FIG. 5 is an enlarged top view of an element of the ignition system of FIG. 3, in accordance with this invention.
Figure 6:
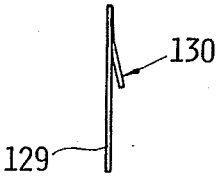
FIG. 6 is a right side elevational view of the element of FIG. 5, in accordance with this invention.

Linkage member 129 is best shown in FIGS. 5 and 6 and includes a downwardly sloping arm 130 which acts as a pawl with respect to the ratchet member 122. The linkage member 129 defines a generally circular aperture 131 which is disposed about the axle member 128. The downward sloping arm 130 sequentially engages the sloping teeth of ratchet member 122 which drives the friction wheel 121 when urged to rotate about a portion of axle member 128. Thus the arm 130 of linkage member 129 acts as a pawl and is sequenced from the peak of a tooth of the ratchet member 122 to the valley of an adjacent tooth. When the ratchet member 122 is rotated, with sufficient acceleration, a one tooth revolution by the arm 130, the attached friction wheel 121 strikes or rubs a portion of the flint 126 and causes a spark.

An aperture 132, best shown in FIG. 5, is engaged by the bent end 133 of an indexing member or cam follower 134. The cam follower 134 is mounted in an aperture in tab 135 of upper portion 108 of frame member 107 and is also positioned through an aperture in connecting portion 110. The cam follower 134 is spring loaded by spring 136. Washer 137 abuts the right side, as seen in FIG. 3, of the "U" shaped end 138 of cam follower 134. The free tip of the "U" shaped end 138 follows the arcuate path 120 of the two-lobed rotary member 115.

Thus the cam follower 134 follows the arcuate path 120 due to the force of biasing spring 136. As the generally axial movement of the cam follower 134 travels the arcuate path 120 from the valley of one lobe to the valley of the other lobe of rotary member 115, the cam follower 134 will be accelerated toward the cap member 119. Accordingly, the linkage member 129 will be jerked about the axis of axle member 128 and urge the friction wheel 121 to rotate one tooth revolution. The friction of the roughened surface of the friction wheel 121 with the flint 126 causes a spark.

The rotational axis of the linkage member 129 and that of the friction wheel 121 are perpendicular or normal to the longitudinal axis of the curling rod. This orientation provides for a compact ignition system in a butane powered curling iron.

In operation, to ignite a combustable gas such as butane, the ring or wheel 118 is rotated 180°. Since the wheel 118 is affixed to the rotary member 115, the rotary member 115 is likewise turned. The direction of rotation may be either clockwise or counterclockwise depending on the chosen design. The end 138 of the cam follower 134 abuts the arcuate path 120 due to the force exerted by spring 136. The axial movement of the cam follower 134 causes the linkage member 129, rotatably mounted on axle member 128, to rotate. The pawl-like arm 130 causes a one tooth revolution of the ratchet member 122 and moves the friction wheel 121 a short rotational amount about the axis of axle member 128. The flint 126, which is mounted in tube member 123, simultaneously rubs against the rotating friction wheel 121 in such a manner that sparks are struck which ignite the gas mixture in the chamber of the barrel 12. After the fuel/air mixture has been ignited in the barrel of the curling iron, catalytic combustion is initiated with the fuel continuously flowing through valve stem 31 which is under constant temperature control. When the curling iron heats up, the fuel flow is stopped. When the curling iron cools sufficiently, the valve stem is axially displaced from its valve seat and fuel flow is initiated. This system is used in combination with the overriding manual on/off control in the manner previously described.

While various aspects of the inventions have been illustrated by the foregoing detailed embodiments, it will be understood that various substitutions of equivalents may be made without departing from the spirit and scope of the inventions.

What is claimed as new and desired to be secured by Letters Patent is:

1. In a hand-held curling device having a tubular body defining a heating chamber therein and having first and second ends and a hair winding portion disposed between the first and second ends and surrounding the heating chamber, an ignition means disposed in the tubular body proximate the second end, a housing mounted proximate the tubular body including a fuel supply means for storing a fuel in a liquid state, and aspirating means coupled between the fuel supply means and the heating chamber for vaporizing the fuel and for mixing the vaporized fuel with air, the improvement comprising:

an inner member positioned coextensive with the tubular body having an air-pervious portion and an end portion, said end portion being substantially air-impervious and including an aperture proximate the ignition means, said end portion diverting most of the vaporized fuel/air mixture through said air-pervious portion of said inner member;

an outer member, positioned coextensively with the tubular body and concentrically disposed about said inner member, said outer member having an air-pervious portion; and a catalytic substrate disposed between said air-pervious portions of said inner and outer members.

2. The curling device as in claim 1 wherein said outer member is a coil wire form.

3. The curling device as in claim 1 wherein said catalyst substrate is a quartz fiber substrate treated with a solution containing a catalyst.

4. The curling device as in claim 1 wherein said inner member is formed of a low heat conductive material having a high heat capacity.

* * * * *